US008167308B2

(12) United States Patent
Tanaka

(10) Patent No.: US 8,167,308 B2
(45) Date of Patent: May 1, 2012

(54) IMAGE FORMING APPARATUS AND METHOD FOR SELECTING DISCHARGE DESTINATION FOR SHEET OF IMAGE FORMING APPARATUS

(75) Inventor: Norio Tanaka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 109 days.

(21) Appl. No.: 12/539,472

(22) Filed: Aug. 11, 2009

(65) Prior Publication Data

US 2010/0156024 A1 Jun. 24, 2010

Related U.S. Application Data

(60) Provisional application No. 61/109,468, filed on Oct. 29, 2008.

(30) Foreign Application Priority Data

Dec. 26, 2008 (JP) ..... P2008-332281

(51) Int. Cl.
*B65H 39/10* (2006.01)

(52) U.S. Cl. ..... 271/298; 271/288

(58) Field of Classification Search ..... 271/298, 271/288

See application file for complete search history.

(56) References Cited

U.S. PATENT DOCUMENTS 6,246,491 B1 * 6/2001 Matsumoto et al. ..... 358/468
2006/0261543 A1 * 11/2006 Miyake et al. ..... 271/292

FOREIGN PATENT DOCUMENTS

JP 02147560 A * 6/1990
JP 02270759 A * 11/1990
JP 04153665 A * 5/1992
JP 2006-089253 4/2006

* cited by examiner

*Primary Examiner* — Stefanos Karmis
*Assistant Examiner* — Luis A Gonzalez
(74) *Attorney, Agent, or Firm* — Patterson & Sheridan, LLP

(57) ABSTRACT

An image forming apparatus is composed of a main body, an image forming portion provided in the main body to form an image on a sheet, a top receiving tray provided on a top of the main body to load the sheet on which the image is formed in the image forming portion so as to be visible from the top of the main body, a side receiving tray provided at a side of the main body and under the top receiving tray to load the sheet on which the image is formed in the image forming portion with a maximum sheet loading amount more than the top receiving tray, and a control unit to control to select one of the top receiving tray and the side receiving tray as a discharge destination for the sheet according to whether or not a number of the output sheets outputted from the image forming portion exceeds a prescribed threshold value.

8 Claims, 9 Drawing Sheets

| | TOP RECEIVING TRAY | SIDE RECEIVING TRAY |
|---|---|---|
| MAXIMUM SHEET LOADING AMOUNT | LITTLE | MANY |
| FIRST COPY TIME | SHORT | LONG |
| VISIBILITY | GOOD | BAD |

IMAGE FORMING APPARATUS AND METHOD FOR SELECTING DISCHARGE DESTINATION FOR SHEET OF IMAGE FORMING APPARATUS

CROSS-REFERENCE TO RELATED APPLICATION

This application is based upon and claims the benefit of priority from the prior U.S. Patent Application No. 61/109,468, filed on Oct. 29, 2008, and Japanese Patent Application No. 2008-332281, filed on Dec. 26, 2008; the entire contents of all of which are incorporated herein by reference.

FIELD OF THE INVENTION

The present invention relates to an image forming apparatus provided with a plurality of sheet receiving trays for receiving discharged sheets on which an image was formed and a method for selecting a discharge destination for the sheet of the image forming apparatus.

DESCRIPTION OF THE BACKGROUND

In Japanese Patent Application Publication No. 2006-89253, an image forming apparatus provided with a plurality of sheet receiving trays different in the sheet loading amounts is disclosed, in which one tray can be selected from the plurality of sheet receiving trays by a user as a sheet receiving tray for receiving discharged sheets on which an image was formed.

Further, it is disclosed that the above-described image forming apparatus is provided with means for judging whether or not a number of the output sheets designated by the user exceeds a prescribed value, and in case that the number of the output sheets exceeds the prescribed value, the image formed sheets are discharged to the sheet receiving tray set by the user. That is, if the user sets a sheet receiving tray with the more sheet loading amount as the discharge destination, in case that the number of the output sheets are many (exceeds the prescribed value), it becomes possible to discharge the sheets to the sheet receiving tray suitable for the discharge (a sheet receiving tray with the more sheet loading amount).

In such an image forming apparatus as this, the discharge destination for the image formed sheets is selected only in consideration of the difference between the sheet loading amounts of the sheet receiving trays. However, in the image forming apparatus provided with a plurality of sheet receiving trays, one case exists where the legibilities of the trays from the user of the image forming apparatus are different because the places in which the trays are arranged are different, and another case and so on where first copy times are different because the lengths of the sheet conveying paths from an image forming portion to the sheet receiving trays are different.

In the image forming apparatus provided with a plurality of sheet receiving trays as these, in case that each of the sheet receiving trays has a different characteristic as described above, it is desirable to select the most suitable sheet discharge destination for the user of the image forming apparatus in consideration of these characteristics. However, any image forming apparatus has never existed in which such a sheet discharge destination selection is applied.

SUMMARY OF THE INVENTION

Accordingly, an advantage of an aspect of the present invention is to provide an image forming apparatus and a method for selecting a discharge destination for a sheet of the image forming apparatus which selects automatically a sheet receiving tray suitable for discharging the sheet, in case of selecting the sheet receiving tray to receive the image formed sheet, in consideration of not only the difference in the sheet loading amount of each tray but also the difference in the visibility from the user and the first copy time of each tray.

To achieve the above advantage, the aspect of the present invention is to provide an image forming apparatus, comprising: a main body; an image forming portion provided in the main body to form an image on a sheet; a top receiving tray provided on a top of the main body to load the sheet on which the image is formed in the image forming portion so as to be visible from the top of the main body; a side receiving tray provided at a side of the main body and under the top receiving tray to load the sheet on which the image is formed in the image forming portion with a maximum sheet loading amount more than the top receiving tray; and a control unit to control to select one of the top receiving tray and the side receiving tray as a discharge destination for the sheet according to whether or not a number of the output sheets outputted from the image forming portion exceeds a prescribed threshold value.

To achieve the above advantage, the aspect of the present invention is to provide a method for selecting a discharge destination for a sheet in a image forming apparatus provided with a main body, an image forming portion provided in the main body to form an image on the sheet, a top receiving tray provided on a top of the main body to load the sheet on which the image is formed in the image forming portion so as to be visible from the top of the main body, a side receiving tray provided at a side of the main body and under the top receiving tray to load the sheet on which the image is formed in the image forming portion with a maximum sheet loading amount more than the top receiving tray, comprising: judging whether or not a number of the output sheets outputted from the image forming portion exceeds a prescribed threshold value; and selecting one of the top receiving tray and the side receiving tray as a discharge destination for the sheet according to the judging result.

DETAILED DESCRIPTION OF THE INVENTION

Hereinafter, embodiments according to the present invention will be described with reference to the drawings.

(First Embodiment)

Figure 1:
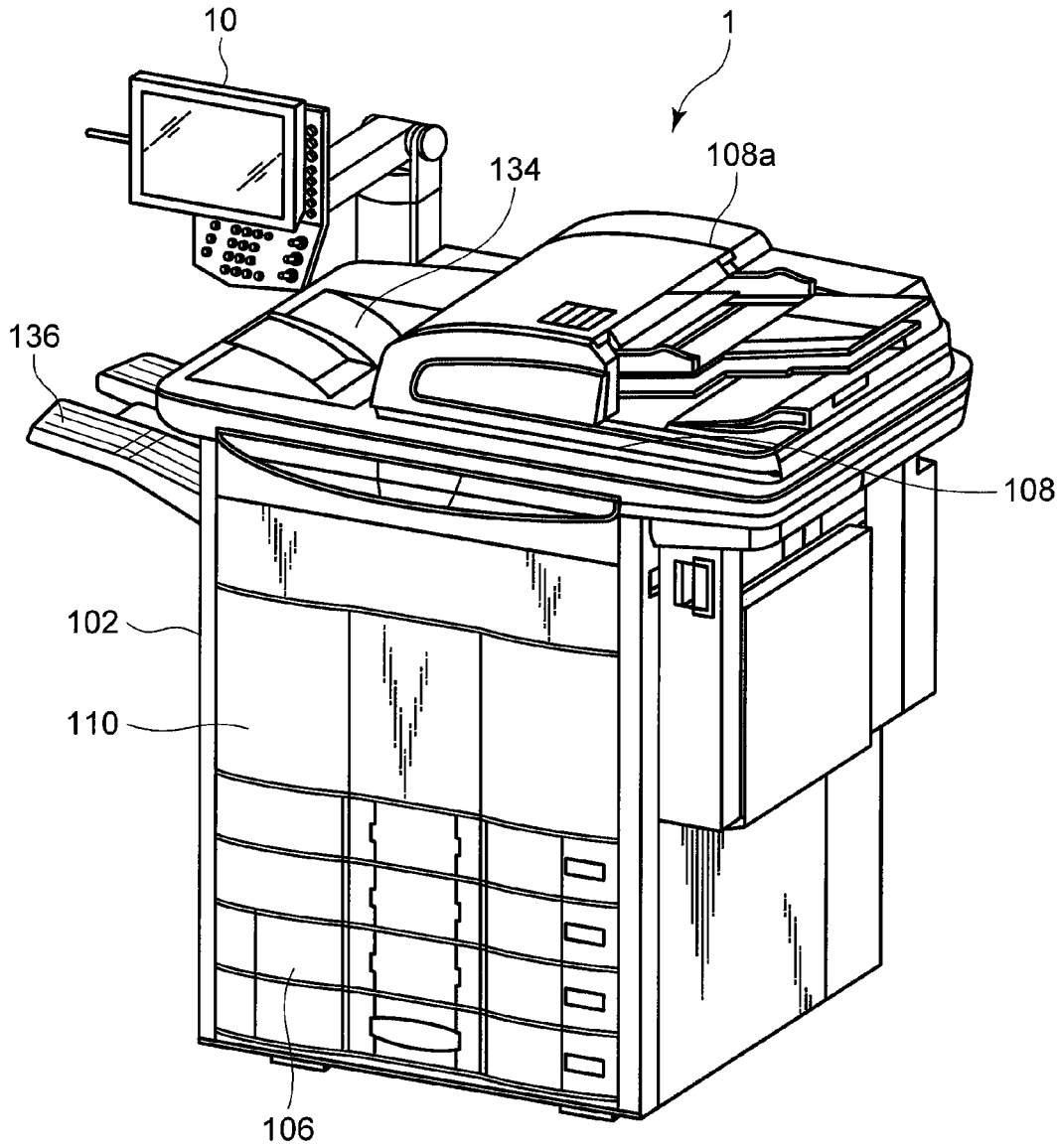
FIG. 1 is a perspective view showing an exterior appearance of an image forming apparatus in a first embodiment of the present invention.

FIG. 1 is a perspective view showing an exterior appearance of an image forming apparatus according to the present invention.

An image forming apparatus 1 is provided with an image forming portion 110 for outputting an image information as an output image, a sheet supply portion 106 capable of supplying sheets P of an arbitrary size used for the image output to the image forming portion 110, and an image reading portion 108 for inputting from a document the image information which is an object to be image formed in the image forming portion 110, as an image data. Further, in the image reading portion 108, an automatic document feeding device (ADF) 108*a* is provided which conveys the document to be read to a reading position and discharges the document which was read already to a discharge position from the reading position, and then conveys the next document to the reading position. In the automatic document feeding device (ADF) 108*a*, a sensor 208 is provided for detecting the passing of the supplied document.

Further, at the backward corner of the apparatus, a control panel 10 is provided at the tip of a swing arm provided rotatably around the support for operating instructions and so on to the image forming portion 110, such as to start the image forming and to start reading the image information of the document.

At the top of a box type main body 102 of the image forming apparatus 1, a top receiving tray 134 is provided to which the image formed sheets P are discharged. Further, the ADF 108*a* is provided at the side of the top receiving tray 134 at the top of the main body of the image forming apparatus 1.

When an user operates the image forming apparatus 1, the user usually stands by the front side of the main body 102 of the image forming apparatus 1 where it is easy to operate the control panel 10. Therefore, the top receiving tray 134 provided at the top of the main body 102 is provided at a position which is not shielded from the user standing position, is visible and easy to take out the sheets P for the user. The loading amount of the top receiving tray 134 is about 100 sheets.

On the other hand, at the side of the main body 102, a side receiving tray 136 is provided to which the image formed sheets P are discharged. The side receiving tray 136 is provided under the top receiving tray 134, as the top receiving tray 134 is provided so as to project to the left side of the main body 102 in the drawing. Further, the side receiving tray 136 has more sheet loading amount compared with the top receiving tray 134, and its sheet loading amount is about 500 sheets.

Figure 2:
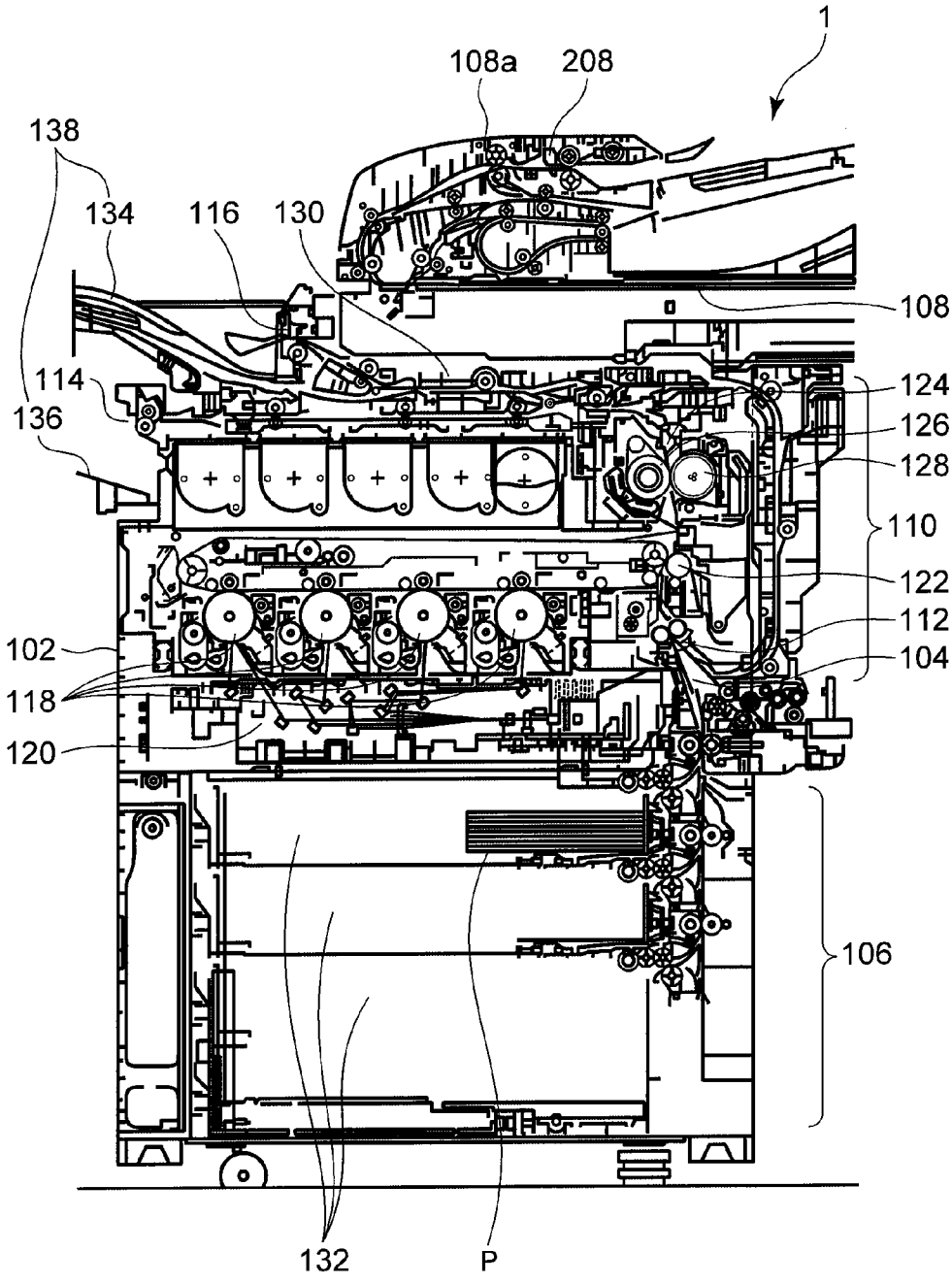
FIG. 2 is a sectional view showing an internal construction of the image forming apparatus shown in FIG. 1.

FIG. 2 is a sectional view showing an internal construction of the image forming apparatus 1 shown in FIG. 1.

The image forming apparatus 1 is provided with the main body 102, a sheet conveying route 104 formed along a prescribed route, the sheet supply portion 106 capable of storing sheets P of a plurality kinds of sizes for supplying the sheets P to the sheet conveying route 104, the image reading portion 108 for reading the image information which is the object to be image formed, the image forming portion 110 for forming the image on the sheet P, and a sheet conveying portion 112 for conveying the sheets P by the guide members and the rollers and so on provided along the sheet conveying route 104. At the outside portion of the main body 102, a first sheet discharge port 116 from which the sheets are discharged to the top receiving tray 134, and a second sheet discharge port 114 arranged, under the first sheet discharge port 116, from which the sheets are discharged to the side receiving tray 136 are provided.

The top receiving tray 134 and the side receiving tray 136 are collectively called as a sheet receiving tray 138.

The image reading portion 108 reads the image information which is the object to be image formed in the image forming portion 110 from the document, as the image data. The image forming portion 110 forms the image, corresponding to the image information instructed and inputted through the communication line from the outside or the image information read by the image reading portion 108, on the sheet P as an output image.

The image forming portion 110 is provided with an exposure device 120 for forming a latent image on a photosensitive drum 118 based on the image information, a developing device for developing the latent image formed on the photosensitive drum 118, a transferring device 122 for transferring a toner image developed on the photosensitive drum 118 on the sheet P, a fixing device 124 for fixing the toner image of the sheet P on which the toner image is transferred by the transferring device 122. The fixing device 124 is constructed with a fixing roller 126 and a pressing roller 128. The fixing roller 126 and the pressing roller 128 send out the sheets P to a conveying route 130 at the prescribed speed. That is, the fixing roller 126 and the pressing roller 128 function as the sheet conveying portion 112 as well.

In this construction, at a lower side area in the image forming apparatus 1, the sheets P are sent respectively upward to the image forming portion 110 by the sheet conveying route 104 from a plurality of sheet cassettes 132, and the images are formed therein. And the image formed sheets P are selectively discharged, by a conveying route 130 provided at an upper side area in the image forming apparatus 1, to the top receiving tray 134 through the first sheet discharge port 116 provided on the top of the main body 102, or to the side receiving tray 136 through the second sheet discharge port 114 provided at the side of the main body 102.

Figure 3:
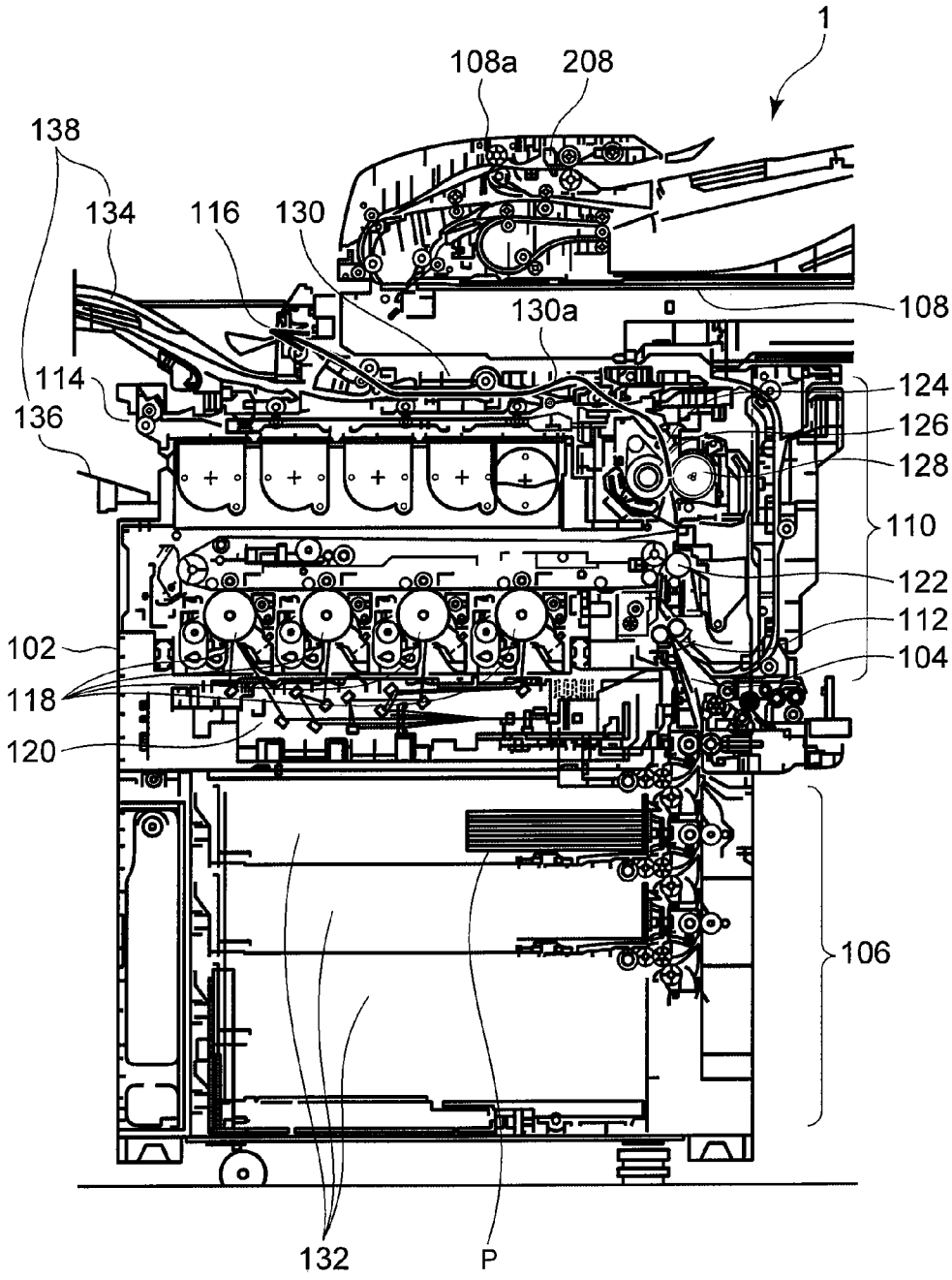
FIG. 3 is a sectional view of the image forming apparatus shown in FIG. 2 showing a length of a conveying path from the fixing device to the first sheet discharge port.
Figure 4:
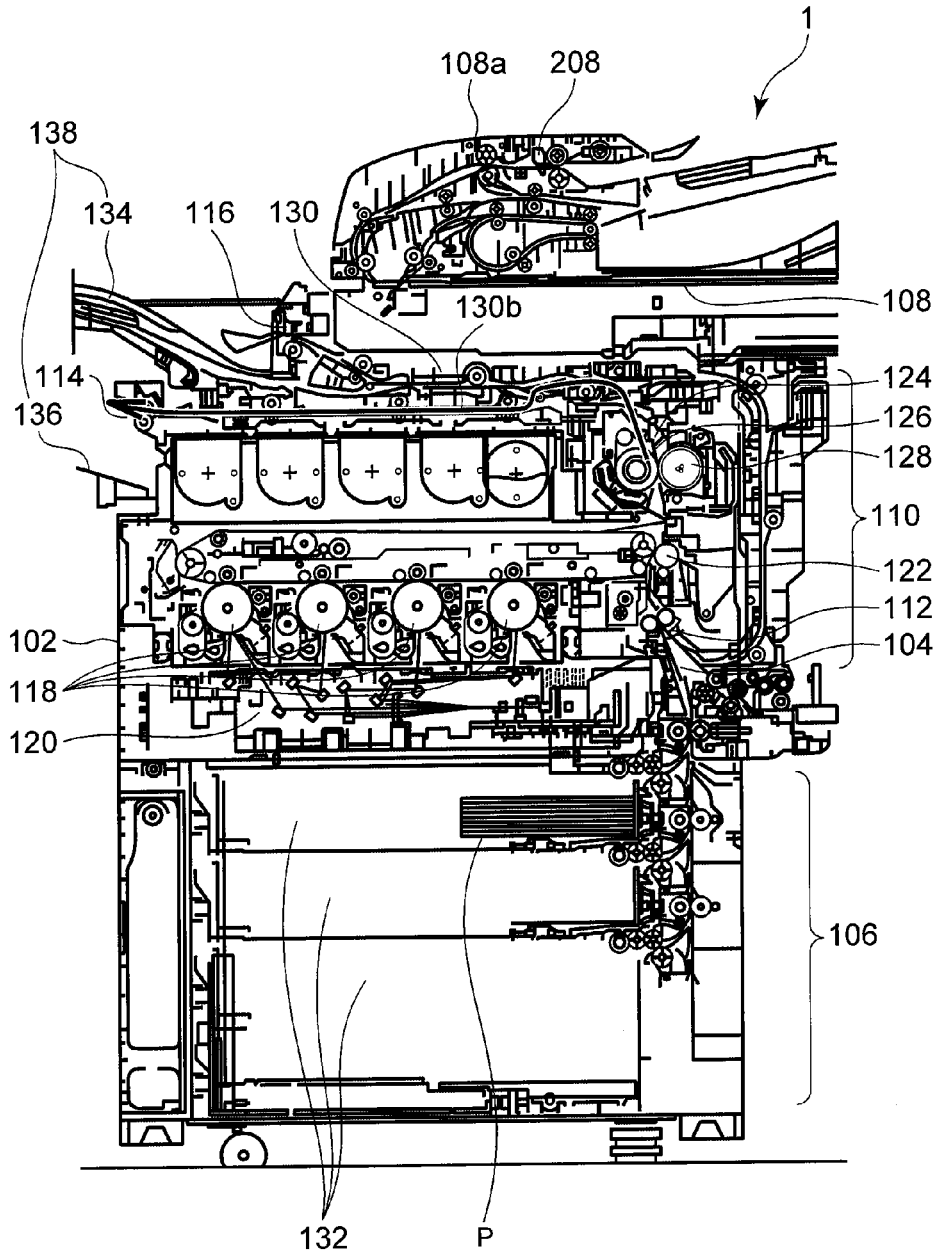
FIG. 4 is a sectional view of the image forming apparatus shown in FIG. 2 showing a length of a conveying path from the fixing device to the second sheet discharge port.

A length of a first conveying path 130*a* from the fixing device 124 of the image forming portion 110 to the first sheet discharge port 116 (shown by the bold line in FIG. 3) is 468 mm, for example. A length of a second conveying path 130*b* from the fixing device 124 to the second sheet discharge port 114 (shown by the bold line in FIG. 4) is 626 mm, for example. Thus, as the first conveying path 130*a* is shorter than the second conveying path 130*b*, a time period for a first sheet of the image formed sheets P to be discharged to the first sheet discharge port 116 is shorter. In addition, a time period from a time when a sheet P is supplied from the sheet cassette 132 to a time when a first sheet of the image formed sheets P is discharged to the sheet receiving tray 138 is called as a first copy time. That is, the image forming apparatus 1 has the characteristics that the first copy time in the case of the top receiving tray 134 is shorter compared with the side receiving tray 136.

Figures 5, 6:
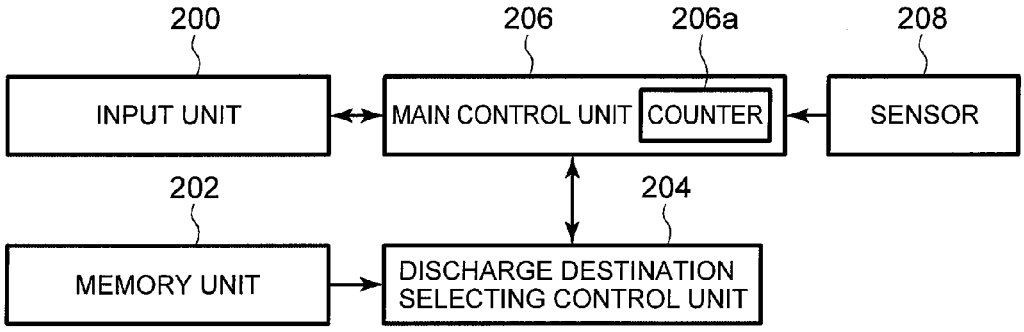
FIG. 5 is a table showing the characteristics of the top receiving tray and the side receiving tray in the first embodiment.
FIG. 6 is a block diagram showing a control unit in the image forming apparatus in the first embodiment.

Due to the above-described construction, the characteristics of the top receiving tray 134 and the side receiving tray 136 are shown in FIG. 5. Thus, in case that the number of the output sheets designated by the user does not exceed the maximum sheet loading amount of the top receiving tray 134, it is preferable to discharge the image formed sheet to the top receiving tray 134 where the visibility is better for the user, the sheets are more easy to be taken out and the first copy time is shorter.

Further, in case that the number of the output sheets designated by the user exceeds the maximum sheet loading amount of the top receiving tray 134, it is preferable to discharge the sheet to the side receiving tray 136 with more maximum sheet loading amount than that of the top receiving tray 134, though the visibility and the first copy time are poorer. Thus, the maximum sheet loading amount of the top sheet receiving tray 134 is determined as a threshold value, and when the number of the output sheets of the image formed sheets is not more than the threshold value, the sheets are discharged to the top receiving tray 134. In case that the number of the output sheets exceeds the threshold value, the sheets are discharged to the side receiving tray 136. As described above, the discharge destination may be automatically selected based on the number of the output sheets.

Next, the selection of the discharge destination for the image formed sheets will be described.

FIG. 6 is a block diagram showing a control unit in the image forming apparatus 1.

The image forming apparatus 1 is provided with an input unit 200 for inputting a print configuration (the number of the sheets of the document, the number of the print copies, both-side printing, one-side printing and so on) by a user, a memory unit 202 for storing a threshold value used for selecting a discharge destination tray for the image formed sheets P, a discharge destination selecting control unit 204 for selecting the discharge destination tray by using the threshold value stored in the memory unit 202, and a main control unit 206 for inputting and outputting the information to and from the input unit 200 and the discharge destination selecting control unit 204 and for controlling the total information in the image forming apparatus 1. Further, the sensor 208 provided in the ADF 108*a* for detecting the passing of the supplied document is connected to the main control unit 206, and the number of the sheets of the document passing through the sensor 208 is counted by a counter 206*a* provided in the main control unit 206.

Figure 7:
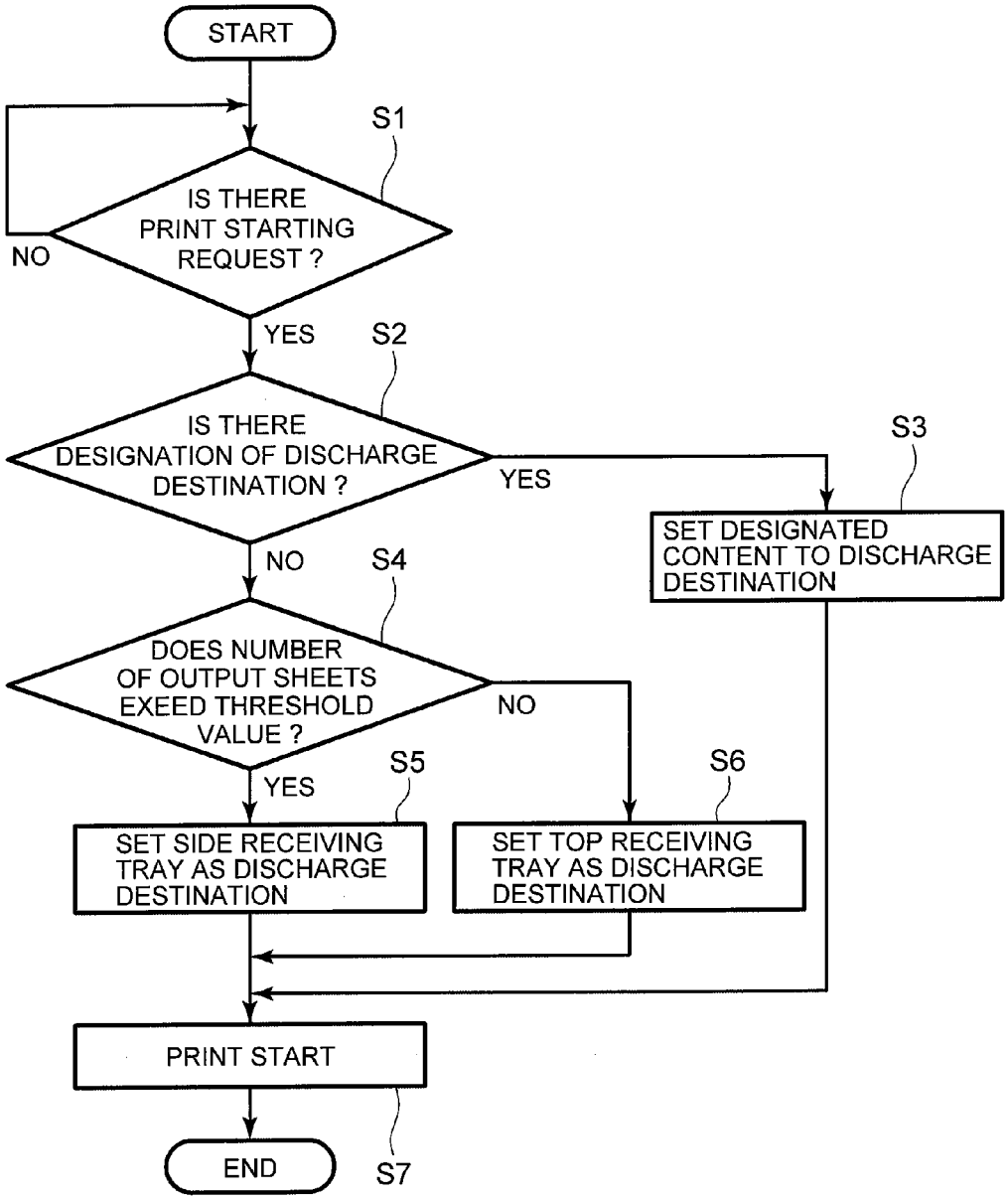
FIG. 7 is a flow chart in selecting the discharge destination tray for the print processed sheets in the first embodiment.

Further, FIG. 7 is a flow chart for determining a discharge destination for image formed sheets in case that a print starting request is made.

In case that a user makes a print starting request from the input unit 200 (S1: YES), next, whether the user designates the discharge destination tray is judged (S2). In case that the user designates the discharge destination tray (S2: YES), the discharge destination tray designated by the user is set as a discharge destination (S3).

On the other hand, in case that the user does not designate the discharge destination tray (S2: NO), whether or not a value of the product (the number of the output sheets) of the number of the sheets of the document and the number of the print copies set by the user from the input unit 200 exceeds the threshold value stored in the memory unit 202 is judged (S4). In case that it is judged that the number of output sheets set by the user exceeds the threshold value (S4: YES), the discharge destination selecting control unit 204 sets as the discharge destination the side receiving tray 136 where the first copy time is longer but the maximum sheet loading amount is more compared with the top receiving tray 134 (S5).

In case that it is judged that the number of output sheets set by the user is not more than the threshold value (S4: NO), the discharge destination selecting control unit 204 sets as the discharge destination the top receiving tray 134 where the maximum sheet loading amount is less, but the first copy time is shorter and the visibility is better compared with the side receiving tray 136 (S6). After determining the discharge destination in the discharge destination selecting control unit 204, the selection result is sent to the main control unit 206, and the print processing (image forming) is started (S7). Then, the sheet P is discharged to the sheet receiving tray 138 designated by the main control unit 206.

By the above-described control, the image forming apparatus 1 according to the above-described embodiment, if the number of the output sheets designated by the user is not more than the threshold value, the discharge to the top receiving tray 134 is selected, where the visibility for the user is better and the image formed sheets can be discharged faster because the first copy time is shorter. Thus, the waiting time for the image formed sheets to be discharged can be made less and the user can easily check the point where the sheets are discharged.

Further, if the number of the output sheets designated by the user exceeds the threshold value, by discharging the sheets to the side receiving tray 136 with the more maximum sheet loading amount compared with the top sheet receiving tray 134, it can be prevented as much as possible that the printing is stopped because the number of the output sheets exceeds the maximum sheet loading amount of the sheet receiving tray 138.

As described above, by judging whether or not the number of the output sheets designated by the user exceeds the threshold value, it becomes possible to discharge the sheet P to the sheet receiving tray 138 suitable for the user.

Further, in the above-described embodiment, the case where the user inputs the number of the sheets of the document and the number of print copies from the control panel 10 was described, but in case that the number of the sheets of the document and the number of the print copies are inputted through the communication line, the number of the output sheets can be counted in the same way.

In addition, in the above-described embodiment, the discharge destination tray is set by the number of the output sheets based on the number of the sheets of the document set by the user from the input unit 200, but in case that the document is loaded on the automatic document feeding device (ADF) 108*a*, the number of the output sheets may be counted by using the number of the sheet of the document.

In this case, at the position of the ADF 108*a* where the document is loaded, a sensor for detecting the loading amount of the document is provided, and the number of the sheets of the document is detected by the sensor. This can be possible by detecting the height of the loaded document optically or by mechanical levers and so on and converting the height to the number of the sheets of the document. The number of the output sheets is counted by the number of the sheets of the document detected by the sensor as described above and the print configuration inputted by the user.

According to the construction described above, even in case that the document is loaded on the ADF 108*a*, it is possible to discharge the image formed sheets P to the discharge destination most suitable for the user, without the need for the designation of the number of the sheets of the document by the user (Second Embodiment)

Hereinafter, a second embodiment will de described by using FIG. 8. The construction of the image forming apparatus 1 and the characteristics (refer to FIG. 5) of the top receiving tray 134 and the side receiving tray 136 are the same as those in the first embodiment.

In the image forming apparatus 1 according to this embodiment, a control method for discharging the sheets P is different from that of the first embodiment in case that the number of the output sheets of the image formed sheets P exceeds the maximum sheet loading amount of the side receiving tray 136.

In case that the number of the output sheets of the image formed sheets P exceeds the maximum sheet loading amount of the side receiving tray 136, if the number of the sheets P which are not discharged to the side receiving tray 136 and remained do not exceed the maximum sheet loading amount of the top receiving tray 134, the sheets P are discharged to the top receiving tray 134, so that the whole printing can be completed by one printing.

On the other hand, if the number of the sheets P which are not discharged to the side receiving tray 136 and remained exceeds the maximum sheet loading amount of the top receiving tray 134, the printing is not completed by one time, so that at the time when the sheets P of the maximum sheet loading amount are loaded on the side receiving tray 136, the printing is once stopped and the sheets P are taken away from side receiving tray 136 by the user, and then the whole printing can be completed by repeating to start the printing again.

Figure 8:
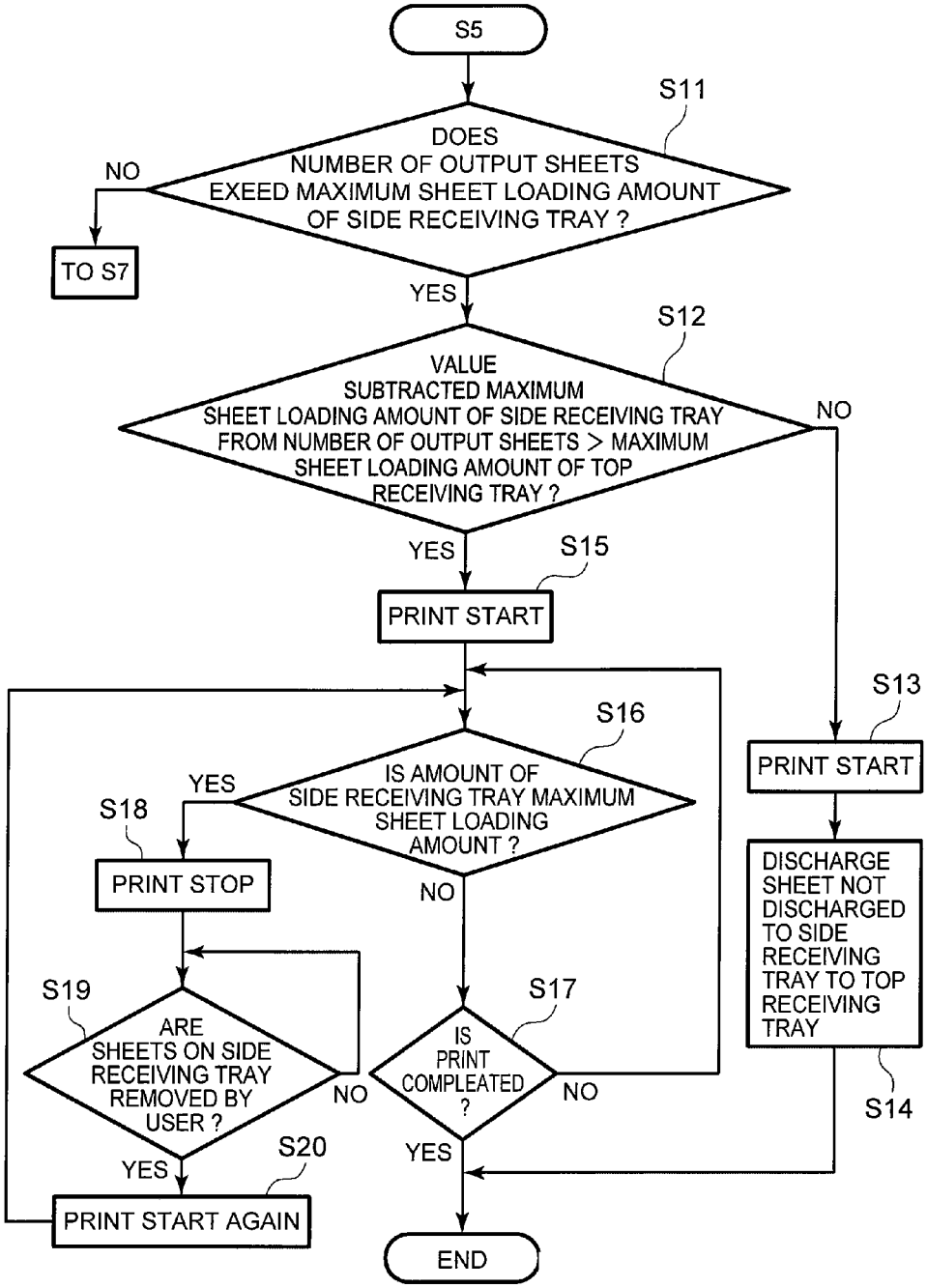
FIG. 8 is a flow chart in selecting the discharge destination tray for the print processed sheets in a second embodiment.

FIG. 8 is a flow chart showing a processing executed in the image forming apparatus 1 in case that the number of the output sheets of the image formed sheets P exceeds the maximum sheet loading amount of the side receiving tray 136, and the processing is executed in addition to the processing of FIG. 7.

That is, in FIG. 7, in case that the number of the output sheets of the image formed sheets P exceeds the threshold value, the side receiving tray 136 is set as the discharge destination (S5). Next, in S11, it is judged whether or not the number of the output sheets exceeds the maximum sheet loading amount of the side receiving tray 136 (S11). As a result of this judgment, in case that it does not exceed the maximum sheet loading amount (S11: NO), the printing is started in S7 of FIG. 7.

On the other hand, in case that that the number of the output sheets is judged to exceed the maximum sheet loading amount in S11, it is judged whether or not a value subtracted the maximum sheet loading amount of the side receiving tray 136 from the number of the output sheets exceeds the maximum sheet loading amount of the top receiving tray 134 (S12).

In S12, in case that the value subtracted the maximum sheet loading amount of the side receiving tray 136 from number of the output sheets does not exceed the maximum sheet loading amount of the top receiving tray 134 (S12: NO), the printing is started (S13), and the sheets P which are not discharged to the side receiving tray 136 and remained are discharged to the top receiving tray 134 (S14). Thus, the printing is completed by one time print starting instruction.

In S12, in case that the value subtracted the maximum sheet loading amount of the side receiving tray 136 from the number of the output sheets exceeds the maximum sheet loading amount of the top receiving tray 134 (S12: YES), the printing is started (S15), and in addition it is judged whether or not the number of the sheets outputted to the side receiving tray 136 gets to the maximum sheet loading amount of the side receiving tray 136 (S16). In S16, in case that the number of the sheets does not get to the maximum sheet loading amount, it is judged whether the whole printing is completed (S17). Then, S16 and S17 are repeated.

In these processing, when it is judged that the number of the sheets outputted to the side receiving tray 136 gets to the maximum sheet loading amount of the side receiving tray 136 in S16, the printing is once stopped (S18). When the printing is stopped, a guidance (not shown) meaning that "please remove the sheets from the side receiving tray" is given to the user. Based on this guidance, whether or not the sheets are removed by the user from the side receiving tray is judged, and the printing is held till the sheets are removed out (S19).

If it is judged in S19 that the sheets are removed out, the printing is started again (S20).

When the printing is started again, the judgment (S16) whether or not the number of the sheets outputted to the side receiving tray 136 gets to the maximum sheet loading amount of the side receiving tray 136 and the judgment (S17) whether the printing is completed are repeated in the same way as described above. In S17, when it is judged that the printing is completed, the printing gets to be completed.

By the control as described above, in case that the number of the output sheets of the image formed sheets P exceeds the maximum sheet loading amount of the side receiving tray 136 and it is impossible to discharge the sheets P to one of the sheet receiving trays 138, if the sheets P not discharged to the side receiving tray 136 and remained does not exceed the maximum sheet loading amount of the top receiving tray 134, the discharge is changed to the top receiving tray 134 without stopping the printing, so that the sheets P can be discharged smoothly.

Further, even in case that the number of the output sheets exceeds the maximum sheet loading amount of the side receiving tray 136 and the sheets P not discharged to the side receiving tray 136 and remained exceeds the maximum sheet loading amount of the top receiving tray 134, by using the side receiving tray 136 repeatedly, one time printing processing can be done by division.

In the above-described embodiment, though the printing is stopped at the time when the number of the output sheets gets to the maximum sheet loading amount of the side receiving tray 136, by stopping the printing at the time when the printing of the prescribed number of copies is completed before getting to the maximum sheet loading amount, the sorting can be done in a unit of a copy and the subsequent troublesomeness can be resolved.

(Third Embodiment)

Hereinafter, a third embodiment will de described by using FIG. 9 and FIG. 10. The construction of the image forming apparatus 1, and the characteristics (refer to FIG. 5) of the top receiving tray 134 and the side receiving tray 136 are the same as those in the first embodiment.

After the image formed sheets P are discharged to the sheet receiving tray 138, if the user does not remove immediately the sheets P from the sheet receiving tray 138, another printing job may start before removing the sheets P. In this time, the maximum sheet loading amount of the sheet receiving tray 138 on which the sheets P are remained to be loaded becomes less than the maximum sheet loading amount in case that the sheets P are not loaded. That is, the loading amount of the sheets which can be newly loaded on the sheet receiving tray 138 is changed by the number of the sheets remained to be loaded.

In this embodiment, by detecting the loading amount of the sheets P which are remained to be loaded on the sheet receiving tray 138, the loading amount of the sheets (the maximum sheet loading amount) which can be newly loaded on the sheet receiving tray 138 is calculated. Then, a sheet loading amount of one tray where the numbers of the sheets which can be newly loaded on the sheet receiving trays 138 is smaller is determined as a threshold value, and the sheet receiving tray for the discharge destination is selected for the print processed sheets P.

Next, a method for selecting a discharge destination for the print processed sheets P in this embodiment will be described concretely.

Figure 9:
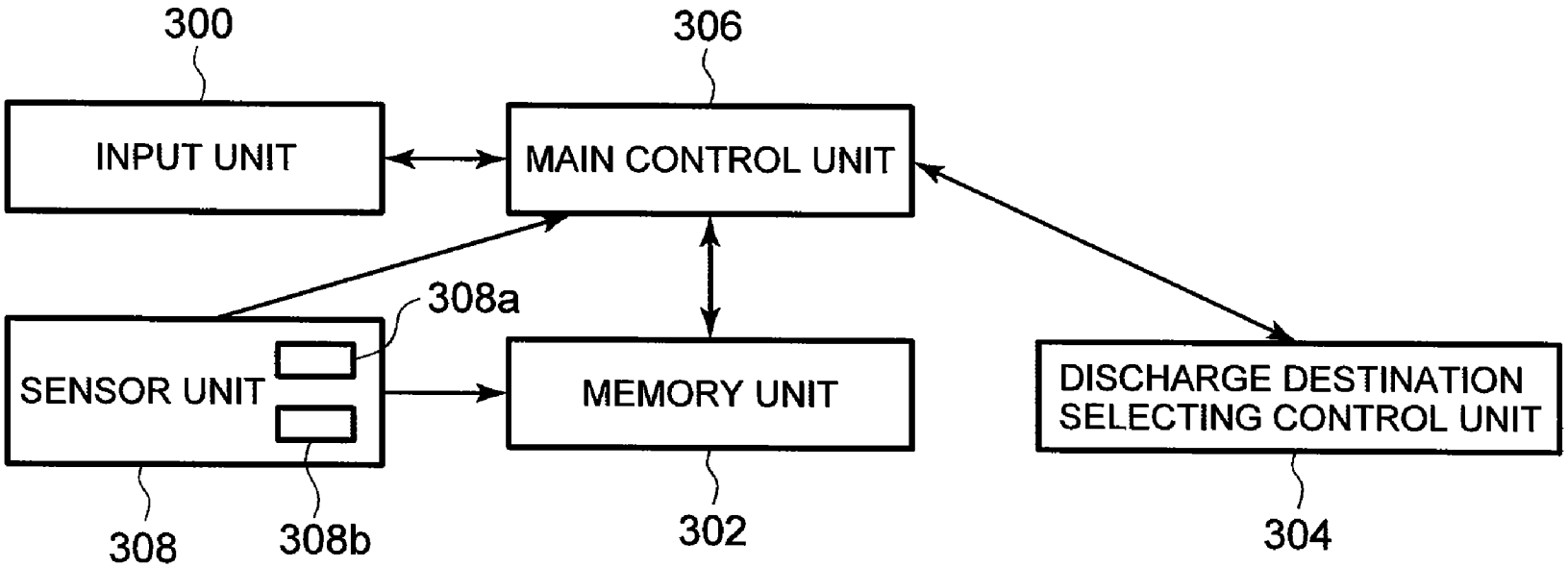
FIG. 9 is a block diagram showing a control unit in the image forming apparatus in a third embodiment.

FIG. 9 is a block diagram showing a control unit of an image forming apparatus 1 according to this embodiment. The image forming apparatus 1 is provided with an input unit 300 for inputting a print configuration (the number of the sheets of the document, the number of print copies, both-side printing, one-side printing and so on) by a user, a sensor unit 308 composed of a first detecting sensor 308*a* for detecting the loading amount of the sheets already discharged on the top receiving tray 134 and a second detecting sensor 308*b* for detecting the loading amount of the sheets already discharged on the side receiving tray 136, a memory unit 302 for storing a threshold value used for selecting a discharge destination tray for the image formed sheets P, a discharge destination selecting control unit 304 for selecting the discharge destination tray by using the threshold value stored in the memory unit 302, and a main control unit 306 for controlling the total information in the image forming apparatus 1.

The sensor for detecting the loading amount of the sheets already discharged on the sheet receiving tray 138 detects a height of the sheets loaded on the sheet receiving tray 138 by optically or by using a mechanical lever and so on, and the height of the sheets can be converted to the number of the sheets. In this case, though to grasp the correct number of the sheets is difficult, the number of the sheets is grasped as a general number of the sheets, and by setting the number of the sheets capable of newly loading less than the maximum sheet loading amount, the height of the loaded sheets may be prevented from going over and being disturbed.

Figure 10:
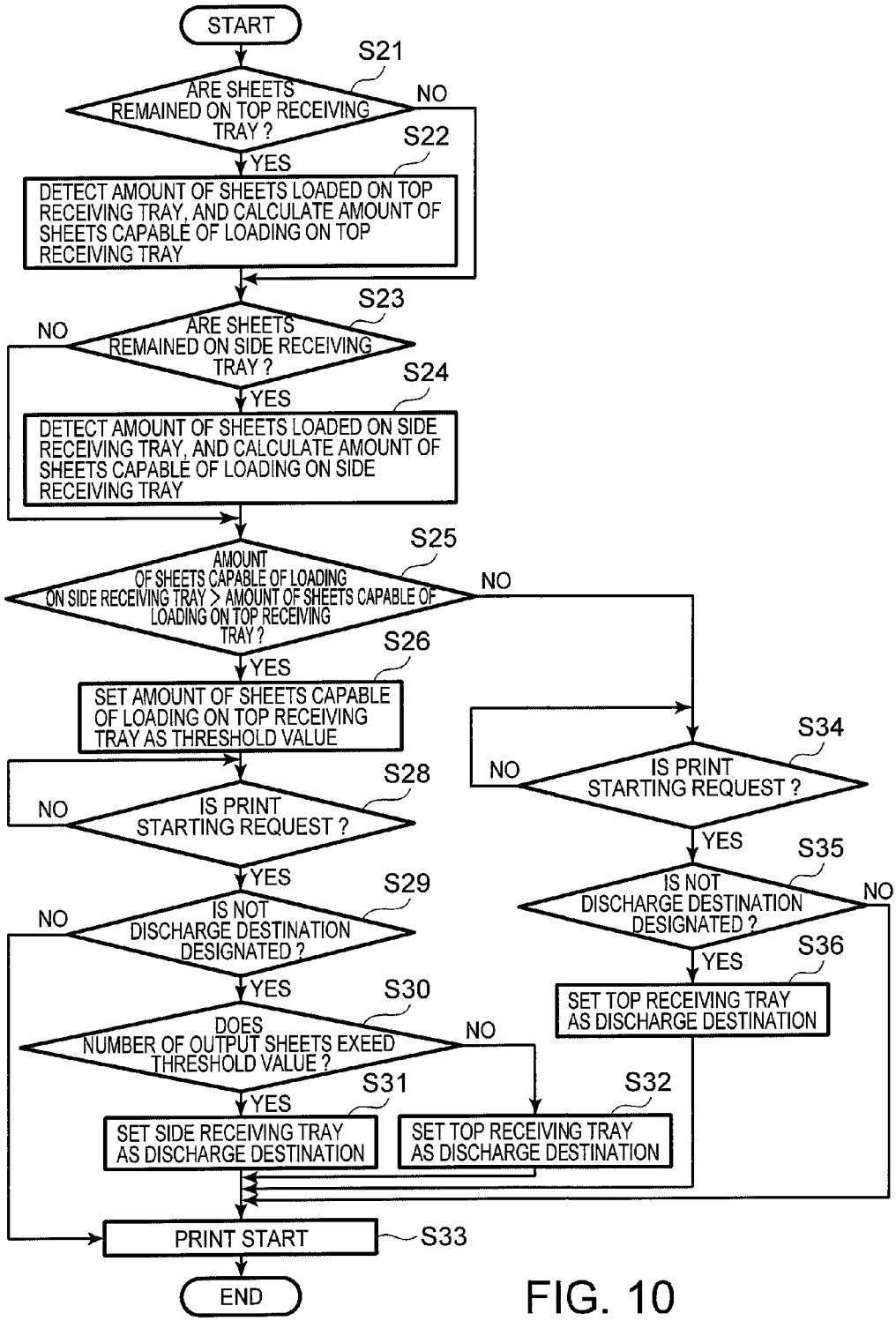
FIG. 10 is a flow chart in selecting the discharge destination tray for the print processed sheets in the third embodiment.

FIG. 10 is a flow chart showing a process for determining a discharge destination for the sheets P in case that the sheets P are already loaded on the sheet receiving tray 138.

First, the main control unit 306 judges whether or not the image formed sheets P are already loaded on the top receiving tray 134 (S21). As a result of this judgment, when the sheets P are already loaded on the top receiving tray 134 (S21: YES), the loading amount of the sheets P loaded on the top receiving tray 134 is detected by the sensor unit 308, and the result is transmitted to the main control unit 306, and the loading amount capable of newly loading the sheets P on the top receiving tray 134 is calculated (S22).

In case that the sheets P are not loaded on the top receiving tray 134 in S21 (S21: NO), the process proceeds on to S23.

Next, whether the sheets P are already loaded on the side receiving tray 136 is judged (S23). As a result of the judgment, when the sheets P are already loaded on the side receiving tray 136 (S23: YES), the loading amount of the sheets P loaded on the side receiving tray 136 is detected by the sensor unit 308, and in the same manner as in S22, the result is transmitted to the main control unit 306 and the loading amount capable of newly loading the sheets P on the side receiving tray 136 is calculated (S24).

In case that the sheets P are not loaded on the side receiving tray 136 in S23 (S23: NO), the process proceeds on to S25.

After the loading amounts capable of newly loading the sheets on both the top receiving tray 134 and the side receiving tray 136 are decided by S21~S24, whether or not the amount of the sheets capable of loading on the top receiving tray 134 is more than the amount of the sheets capable of loading on the side receiving tray 136 is compared by the main control unit 306 (S25). In case that the amount of the sheet capable of loading on the side receiving tray 136 is more than the amount of the sheets capable of loading on the top receiving tray 134 (S25: YES), the amount of the sheet capable of loading on the top receiving tray 134 is set (updated) as a threshold value (S26).

The processing S28~S33 after setting the threshold value is the same as in S1~S6 shown in the flow chart of FIG. 5 in the first embodiment.

On the other hand, in case that the amount of the sheet capable of loading the side receiving tray 136 is not more than the amount of the sheets capable of loading the top receiving tray 134 (S25: NO), when the print starting request is made (S34: YES), whether or not the designation of the discharge destination by the user is made is judged (S35).

In case that the designation of the discharge destination is not made by the user (S35: YES), the sheets are controlled by the main control unit 306 to be always discharged to the top receiving tray 134 (S36). The top receiving tray 134 has the less sheet loading amount compared with the side receiving tray 136. As the top receiving tray 134 is better in the visibility and the first copy time is shorter, the top receiving tray 134 is the most suitable discharge destination for discharging the image formed sheets P. After the top receiving tray 134 is set as the discharge destination in S36 as in this manner, the printing is started (S33).

According to the above-described construction, the image forming apparatus 1 can discharge the sheets P to the most suitable discharge destination for the user by changing the threshold value used in selecting the discharge destination, even in case that the sheets P are remained on the sheet receiving tray 138

Further, though the above-described embodiments were described using the case that the top receiving tray 134 projects over the side receiving tray 136, the case that the top receiving tray 134 does not project from the side may be used. In this case, that the side receiving tray 136 is provided under the top receiving tray 134 means that the side receiving tray 136 is provided relatively under the top receiving tray 134. Though the top receiving tray 134 does not project, if the side receiving tray 136 is provided under the top receiving tray 134 at the side of the image forming apparatus 1, the side receiving tray 136 is worse in the visibility compared with the top receiving tray 134. Therefore, it may be said that the difference of the characteristics shown in FIG. 5 may be applied to this case.

What is claimed is:

1. An image forming apparatus, comprising:

a main body;

an image forming portion provided in the main body to form an image on a sheet;

a top receiving tray provided on a top of the main body to load the sheet on which the image is formed in the image forming portion so as to be visible from the top of the main body;

a side receiving tray provided at a side of the main body and under the top receiving tray to load the sheet on which the image is formed in the image forming portion with a maximum sheet loading amount more than a maximum sheet loading amount of the top receiving tray;

a control unit to select one of the top receiving tray and the side receiving tray as a discharge destination for the sheet according to whether or not a number of the output sheets outputted from the image forming portion exceeds a prescribed threshold value, wherein the control unit is configured to:

judge whether or not the number of the output sheets outputted from the image forming portion exceeds the maximum sheet loading amount of the side receiving tray;

judge whether or not the maximum sheet loading amount of the side receiving tray subtracted from the number of the estimated output sheets exceeds the maximum sheet loading amount of the top receiving tray, when judging that the number of the output sheets exceeds the maximum sheet loading amount of the side receiving tray; and select the side receiving tray as a discharge destination of a number of output sheets within a range of the maximum sheet loading amount of the side receiving tray when judging that the maximum sheet loading amount of the side receiving tray subtracted from the number of the output sheets exceeds the maximum sheet loading amount of the top receiving tray, and to select the top receiving tray as a discharge destination of the number of output sheets exceeding the maximum sheet loading amount of the side receiving tray when judging that the maximum sheet loading amount of the side receiving tray subtracted from the number of the output sheets does not exceed the maximum sheet loading amount of the top receiving tray.

2. An image forming apparatus, comprising:

a main body;

an image forming portion provided in the main body to form an image on a sheet;

a top receiving tray provided on a top of the main body to load the sheet on which the image is formed in the image forming portion so as to be visible from the top of the main body;

a side receiving tray provided at a side of the main body and under the top receiving tray to load the sheet on which the image is formed in the image forming portion with a maximum sheet loading amount more than a maximum sheet loading amount of the top receiving tray;

a control unit to select one of the top receiving tray and the side receiving tray as a discharge destination for the sheet according to whether or not a number of the output sheets outputted from the image forming portion exceeds a prescribed threshold value;

a first detecting sensor to detect a sheet loading amount of the sheets discharged on the top receiving tray; and a second detecting sensor to detect a sheet loading amount of the sheets discharged on the side receiving tray, wherein the control unit is configured to:

calculate a remaining sheet loading amount of the sheets capable to be newly loaded on the top receiving tray from the sheet loading amount on the top receiving tray detected by the first detecting sensor;

calculate a sheet loading amount of the sheets capable to be newly loaded on the side receiving tray from the sheet loading amount on the side receiving tray detected by the second detecting sensor; and renew the sheet loading amount of the top receiving tray that was calculated as the threshold value when the sheet loading amount of the top receiving tray that was calculated is less than the sheet loading amount of the side receiving tray that was calculated.

3. The apparatus according to claim 2, control unit is configured to receive an input including a number of the sheets of the document and a number of print copies, and wherein the number of estimated output sheets is estimated by multiplying the number of sheets of the document and the number of the print copies.

4. An image forming apparatus, comprising:

a main body;

an image forming portion provided in the main body to form an image on a sheet;

a top receiving tray provided on a top of the main body to load the sheet on which the image is formed in the image forming portion so as to be visible from the top of the main body;

a side receiving tray provided at a side of the main body and under the top receiving tray to load the sheet on which the image is formed in the image forming portion, wherein a maximum sheet loading amount of the side receiving tray is more than a maximum sheet loading amount of the top receiving tray;

a first conveying path to convey the sheets from the image forming portion to the top receiving tray;

a second conveying path to convey the sheets from the image forming portion to the side receiving tray, wherein the first conveying path is shorter than the second conveying path; and a control unit to select one of the top receiving tray and the side receiving tray as a discharge destination for the sheet according to whether or not an estimated number of the output sheets to be outputted from the image forming portion exceeds a prescribed threshold value, wherein the control unit is configured to:

judge whether or not the number of the output sheets outputted from the image forming portion exceeds the maximum sheet loading amount of the side receiving tray;

judge whether or not the maximum sheet loading amount of the side receiving tray subtracted from the number of the estimated output sheets exceeds the maximum sheet loading amount of the top receiving tray, when judging that the number of the output sheets exceeds the maximum sheet loading amount of the side receiving tray; and select the side receiving tray as a discharge destination of a number of output sheets within a range of the maximum sheet loading amount of the side receiving tray when judging that the maximum sheet loading amount of the side receiving tray subtracted from the number of the output sheets exceeds the maximum sheet loading amount of the top receiving tray, and to select the top receiving tray as a discharge destination of the number of output sheets exceeding the maximum sheet loading amount of the side receiving tray when judging that the maximum sheet loading amount of the side receiving tray subtracted from the number of the output sheets does not exceed the maximum sheet loading amount of the top receiving tray.

5. An image forming apparatus, comprising:

a main body;

an image forming portion provided in the main body to form an image on a sheet;

a top receiving tray provided on a top of the main body to load the sheet on which the image is formed in the image forming portion so as to be visible from the top of the main body;

a side receiving tray provided at a side of the main body and under the top receiving tray to load the sheet on which the image is formed in the image forming portion, wherein a maximum sheet loading amount of the side receiving tray is more than a maximum sheet loading amount of the top receiving tray;

a control unit to select one of the top receiving tray and the side receiving tray according to whether or not a number of the output sheets outputted from the image forming portion exceeds a prescribed threshold value;

a first conveying path to convey the sheets from the image forming portion to the top receiving tray;

a second conveying path to convey the sheets from the image forming portion to the side receiving tray, wherein the first conveying path is shorter than the second conveying path;

a first detecting sensor to detect a sheet loading amount of the sheets discharged on the top receiving tray; and a second detecting sensor to detect a sheet loading amount of the sheets discharged on the side receiving tray, wherein the control unit is configured to:

calculate a remaining sheet loading amount of the sheets capable to be newly loaded on the top receiving tray from the sheet loading amount on the top receiving tray detected by the first detecting sensor;

calculate a sheet loading amount of the sheets capable to be newly loaded on the side receiving tray from the sheet loading amount on the side receiving tray detected by the second detecting sensor; and renew the calculated sheet loading amount of the top receiving tray as the threshold value when the calculated sheet loading amount of the top receiving tray is less than the calculated sheet loading amount of the side receiving tray.

6. A method for selecting a discharge destination for a sheet in an image forming apparatus provided with a main body, an image forming portion provided in the main body to form an image on the sheet, a top receiving tray provided on a top of the main body to load the sheet on which the image is formed in the image forming portion so as to be visible from the top of the main body, a side receiving tray provided at a side of the main body and under the top receiving tray to load the sheet on which the image is formed in the image forming portion with a maximum sheet loading amount more than the top receiving tray, comprising:

judging, using a control unit, whether or not an estimated number of the output sheets to be outputted from the image forming portion exceeds a prescribed threshold value;

selecting, using the control unit, one of the top receiving tray and the side receiving tray as a discharge destination for the sheet according to the judging result;

a first judging step, using the control unit, for judging whether or not the estimated number of the output sheets to be outputted from the image forming portion exceeds the maximum sheet loading amount of the side receiving tray;

a second judging step for, using the control unit, judging whether or not the maximum sheet loading amount of the side receiving tray subtracted from the number of the estimated output sheets exceeds the maximum sheet loading amount of the top receiving tray, when judging that the number of the output sheets exceeds the maximum sheet loading amount of the side receiving tray; and selecting, using the control unit, the side receiving tray as a discharge destination of a number of output sheets within a range of the maximum sheet loading amount of the side receiving tray when the result of the second judging step is that the maximum sheet loading amount of the side receiving tray subtracted from the number of the output sheets exceeds the maximum sheet loading amount of the top receiving tray, and selecting, using the control unit, the top receiving tray as a discharge destination of the number of output sheets exceeding the maximum sheet loading amount of the side receiving tray when the result of the second judging step is that that the maximum sheet loading amount of the side receiving tray subtracted from the number of the output sheets does not exceed the maximum sheet loading amount of the top receiving tray.

7. A method for selecting a discharge destination for a sheet in an image forming apparatus provided with a main body, an image forming portion provided in the main body to form an image on the sheet, a top receiving tray provided on a top of the main body to load the sheet on which the image is formed in the image forming portion so as to be visible from the top of the main body, a side receiving tray provided at a side of the main body and under the top receiving tray to load the sheet on which the image is formed in the image forming portion with a maximum sheet loading amount more than the top receiving tray, comprising:

judging, using a control unit, whether or not a number of the output sheets outputted from the image forming portion exceeds a prescribed threshold value;

selecting, using the control unit, one of the top receiving tray and the side receiving tray as a discharge destination for the sheet according to the judging result;

a first detecting, using the control unit, step for detecting a sheet loading amount of the sheets discharged on the top receiving tray;

a second detecting, using the control unit, step for detecting a sheet loading amount of the sheets discharged on the side receiving tray;

a first calculating, using the control unit, step for calculating a remaining sheet loading amount of the sheets capable to be newly loaded on the top receiving tray from the sheet loading amount on the top receiving tray detected by the first detecting step;

a second calculating step, using the control unit, for calculating a sheet loading amount of the sheets capable to be newly loaded on the side receiving tray from the sheet loading amount on the side receiving tray detected by the second detecting step; and renewing, using the control unit, the sheet loading amount of the top receiving tray calculated by the first calculating step as the threshold value when the sheet loading amount of the top receiving tray calculated by the first calculating step is less than the sheet loading amount of the side receiving tray calculated by the second calculating step.

8. A method for selecting a discharge destination for a sheet in an image forming apparatus provided with a main body, an image forming portion provided in the main body to form an image on the sheet, a top receiving tray provided on a top of the main body to load the sheet on which the image is formed in the image forming portion so as to be visible from the top of the main body, a side receiving tray provided at a side of the main body and under the top receiving tray to load the sheet on which the image is formed in the image forming portion with a maximum sheet loading amount more than the top receiving tray, comprising:

judging, using a control unit, whether or not an estimated number of the output sheets to be outputted from the image forming portion exceeds a prescribed threshold value; and selecting, using the control unit, one of the top receiving tray and the side receiving tray as a discharge destination for the sheet according to the judging result, and when the estimated number of output sheets to be outputted exceeds the maximum sheet loading amount of the side receiving tray, stopping image forming at a unit of print copies less than the total amount of print copies and at a sheet amount less than the maximum sheet loading amount of the side receiving tray.

* * * * *